US006213388B1

(12) United States Patent
Ours et al.

(10) Patent No.: US 6,213,388 B1
(45) Date of Patent: Apr. 10, 2001

(54) DISPENSING ASSEMBLY FOR A LINED CARTON AND PROCESS AND APPARATUS THEREOF

(75) Inventors: David C. Ours, Marshall; James O. Robotham, Nashville; David L. Bradley; Michael Borgerson, both of Battle Creek, all of MI (US)

(73) Assignee: Kellogg Company, MI (US)

( * ) Notice: Subject to any disclaimer, the term of this patent is extended or adjusted under 35 U.S.C. 154(b) by 0 days.

(21) Appl. No.: 09/213,100

(22) Filed: Dec. 17, 1998

Related U.S. Application Data

(63) Continuation-in-part of application No. 09/150,966, filed on Sep. 10, 1998, which is a continuation-in-part of application No. 09/050,533, filed on Mar. 30, 1998, now Pat. No. 6,062,467.

(60) Provisional application No. 60/069,859, filed on Dec. 17, 1997.

(51) Int. Cl.[7] ..... B65D 5/74; B65B 7/00

(52) U.S. Cl. ..... 229/117.3; 229/117.31; 229/117.35; 229/125.04; 229/215; 53/133.2; 53/133.4; 53/281; 53/471; 53/478

(58) Field of Search ..... 229/117.3, 117.31, 229/117.35, 125.04, 125.09, 125.14, 125.15, 215, 217; 222/541.5, 572, 573, 556, 563, 527, 528, 533; 53/133.2, 133.4, 281, 471, 478; 493/87

(56) References Cited

U.S. PATENT DOCUMENTS

| | | | |
|---|---|---|---|
| 2,536,529 | 1/1951 | Bergstein . | |
| 2,593,778 | 4/1952 | McGinnis . | |
| 2,820,585 | 1/1958 | Nerenberg et al. . | |
| 2,862,649 * | 12/1958 | Bergstein | 222/531 |
| 2,998,788 * | 9/1961 | Back et al. | 493/87 |
| 3,127,082 | 3/1964 | Meyer-Jagenberg . | |
| 3,250,436 | 5/1966 | Kurtz . | |
| 3,426,955 | 2/1969 | Olson . | |
| 3,768,719 | 10/1973 | Johnson . | |
| 4,565,315 | 1/1986 | Wagner et al. . | |
| 5,013,878 | 5/1991 | Fries, Jr. . | |
| 5,014,888 | 5/1991 | Bryan . | |
| 5,857,614 * | 1/1999 | Walsh | 229/231 |

FOREIGN PATENT DOCUMENTS

| | | |
|---|---|---|
| 394 780 | 12/1965 | (CH) . |
| 569 629 | 11/1975 | (CH) . |
| 99 30974 | 6/1999 | (WO) . |

OTHER PUBLICATIONS

The Wiley Encyclopedia of Packaging Technology, Bakker, John Wiley & Sons. 1986.

* cited by examiner

*Primary Examiner*—Gary E. Elkins
(74) *Attorney, Agent, or Firm*—Fulbright & Jaworski, LLP

(57) ABSTRACT

Dispensing assembly for a carton with a sealed liner filled with product therein. A pour spout or flap is mounted to a dispensing opening to pivot between an open and closed positions. The liner is bonded to the pour spout or flap in a way that when the spout or flap is initially opened, that portion of the liner bonded thereto separates from the rest of the liner, providing access to the contents thereof.

59 Claims, 12 Drawing Sheets

DISPENSING ASSEMBLY FOR A LINED CARTON AND PROCESS AND APPARATUS THEREOF

RELATED APPLICATION

This application is a continuation-in-part of application Ser. No. 09/150,966 filed Sep. 10, 1998 which is a continuation-in-part of application Ser. No. 09/050,533 filed Mar. 30, 1998, now U.S. Pat. No. 6,062,467, which claims priority from Provisional application Ser. No. 60/069,859 filed Dec. 17, 1997, all of which are incorporated herein by reference.

BACKGROUND

This invention relates to the packaging of dry particulate foods such as ready-to-eat ("RTE") cereal. More specifically, this invention relates to lined cartons of the type known as a bag-in-a-box with reclosable dispensing means connected to the liner or bag in such a way that a portion thereof is separated from the liner upon initial opening of the dispensing means to provide access to the contents of the carton.

The use of cartons with liner bags for dry particulate products such as RTE cereal is well known. Such cartons are usually formed from a blank of paperboard or similar material comprising sidewalls with top and bottom flaps. The liner is a plastic or coated paper bag which holds the particulate product. The liner can be filled and sealed before or after being placed inside an open carton, the flaps of which are then folded and sealed.

Access to the contents of such cartons involves breaking the seal between the top flaps of the carton and pulling open the sealed liner bag. Resealing is often difficult and incomplete leading to a loss of freshness of the product. RTE cereal, for example, has a low moisture content and readily absorbs moisture from the air leading to a loss of crispness.

Dispensing devices such as pour spouts have been proposed to control the discharge of particulate product and minimize exposure to the atmosphere. However, when a carton with a pour spout contains a filled and sealed liner bag, the bag must be manually torn or cut with a knife or scissors when the spout is first opened. This arrangement has several drawbacks not the least of which is manually cutting or tearing of the liner bag. Once opened, and as the contents are depleted, the liner bag and its contents slide and shift positions in the carton which can cause the opened portion of the liner to become misaligned with the pour spout opening thereby hindering dispensing of product from the carton. This also causes product to drop between the carton and the liner.

U.S. Pat. No. 2,998,788 relates to bag-in-a-box packaging where a liner is sandwiched between a metal spout and a precut flap in the carton side wall. A cut-out in the side wall above the flap allows the insertion of a knife to cut the liner and open the spout. The liner is bonded to the spout and the carton flap using a heated anvil which is inserted into an empty, lined carton.

SUMMARY OF THE INVENTION

The present invention is directed towards an improved bag-in-a-box container where the bag or liner in the box is filled with product and sealed. The box has a dispensing flap and while the filled, sealed liner is in the box the liner is sealed to the flap in such a way that the bag remains sealed but upon initial opening of the flap, that portion bonded to the flap separates from the liner to provide access to the contents of the container.

A preferred carton has a pivotable pour spout mounted to a dispensing opening or flap. A front panel of the pour spout is bonded to a portion of the liner bag while it is filled and sealed without braking the seal and, when initially opened, that portion partly separates from the rest of the liner thereby providing access to the contents of the carton. Thus, as the pour spout is manually opened for the first time, the liner bonded to the front panel separates to create an opening while remaining integral with the liner along the pivot axis.

Because the portion of the liner that separates corresponds to the size of the dispensing opening, reclosure of the pour spout fills the opening to minimize contact of the contents with the outside atmosphere. Moreover, the liner stays connected at the bottom of the dispensing opening to maintain alignment.

It is preferred to heat seal the liner along the top and side edges of the flap or front panel in a way that creates weakened tear lines in the liner, but without breaking the seal of the liner, to facilitate initial opening of the flap or pour spout. The liner can also be bonded adjacent the dispensing opening or flap to further maintain alignment and prevent product from falling between the bag and the box. The present invention is also directed to an improved one-piece pour spout assembly including a fitment defining a dispensing opening with upper and lower margin portions adjacent thereto, and a pour spout having side panels and a front panel integral with the lower margin portion such that when the pour spout is folded over the fitment, the front panel overlies (or is in register with) the dispensing opening. A preferred fitment has side members and a cut-out piece corresponding to the dispensing opening which is bonded to the front panel of the pour spout. The cut-out piece can have vertical edges that extend into the side pieces at right angles to the front panel of the pour spout. This provides for a tight fit on reclosing the spout to minimize exposure to the outside atmosphere.

DESCRIPTION OF THE DRAWINGS

The present invention will be more fully understood from the following description and the accompanying drawings wherein.

DESCRIPTION

Figure 1A:
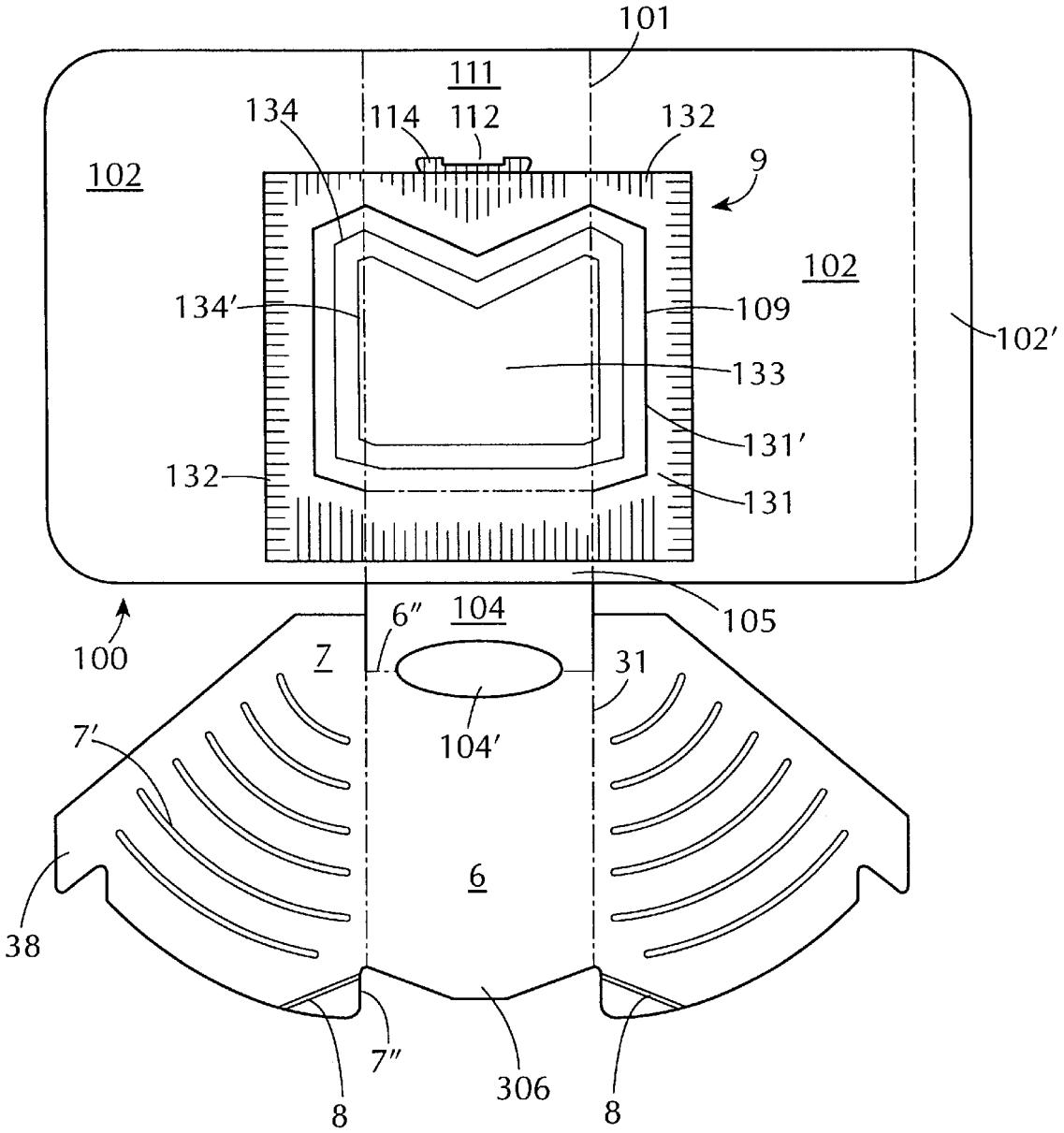
FIG. 1A is a plan view of a pour spout of the invention opened up and laid flat.

It is preferred to use a conventional paperboard carton with a separate or integral pour spout made of plastic or paperboard and a conventional plastic liner bag that is filled and sealed before or after being inserted into an open top carton. Numerous apparatus and processes using such materials and techniques for packaging RTE cereal are known and available.

In carrying out the present invention, a portion of a filled and sealed liner bag is brought into contact and bonded with the front panel of a pour spout or a flap mounted in a dispensing opening in a side panel or end wall of a carton. Reduced pressure means such as a vacuum enclosure can be used to bring about sealing contact between the liner and a flap or front panel of the pour spout.

An activatable hot melt adhesive is positioned in the desired pattern between the liner and the flap or front panel and externally activated by delivering bonding energy to the interface such as by induction heating. This can be done by including a heat generating substance in or with the hot melt adhesive that will generate heat to activate the adhesive. Such substances include metal foils such as aluminum foil laminated on one or both sides to a hot melt adhesive, metal salts such as magnesium chloride, chromium nitrate, aluminum chloride and the like, mixed with a hot melt adhesive or metal particles such as iron or aluminum powder mixed with or flocked onto a hot melt adhesive applied in the desired pattern to the flap or front panel.

When using magnetizable particles such as iron, a magnet can be employed to orient the particles and promote bonding with the liner. Metal salts and metal particles are used in amounts sufficient to activate the adhesive when external bonding energy is applied.

Hot-melt adhesives are 100% solids and are applied in hot, molten form. They set fast when heat is removed and can be preapplied and reactivated later by the application of heat. Hot melt adhesives are typically formulated with a backbone polymer such as ethylene-vinyl acetate or polyethylene. The main polymer is usually let down with a diluent such as wax to improve melt flow properties. Antioxidants are a component since the adhesive is applied hot and is subject to oxidation. Tackifiers improve hot tack and viscosity. Other materials influence melt temperature. Added colorants can make the adhesive more visible.

Hot-melt adhesives are readily available from numerous sources. INSTANT LOK® hot melt adhesives from National Starch and Chemical Corporation of Bridgewater N.J. 08807 are suitable for use in the invention.

Metal foil laminates are preferred for ease of application and activation.

A typical metal foil laminate includes aluminum foil, generally vacuum metalized aluminum on a polyester film, with a linear low density polyethylene adhesive on one or both sides. Curwood Inc., of Oshkosh, Wis. 54903, provides CURLAM® Grade 5432 film with adhesive on one side. It is preferred to coat both sides of the film with an adhesive which enables the use of induction heating to bond the foil laminate to the front panel and the liner at the same time.

Induction heating equipment is widely used in the packaging field and suitable units for use in the invention are available from Lepel Corporation of Edgewood, N.Y. 11717 and Amertherm, Inc. of Scottsville, N.Y. 14546.

The intensity and duration of the induction field required to bond the liner to the front panel depends on the composition of the heat activatable adhesive. For example, an aluminum foil laminated with linear, low density polyethylene generally achieves its sealing temperature in 0.9 to 1.2 seconds when exposed to a Lepel, LEPAK, Jr. 750 watt induction sealer. An adhesive including a resin base with about 5 to 10 weight percent metallic salt, such as chromium nitrate or aluminum chloride, generally reaches its sealing temperature in under 2.0 seconds when placed in an 800 watt GE microwave oven operating at 900 to 1100 kHz.

Other induction heating systems and heat activatable adhesives can be adopted to the present invention. For example, an induction heating system for sealing packages using magnetic susceptible particles and heat softenable adhesives and high frequency alternating magnetic fields is disclosed in U.S. Pat. No. 3,879,247 which is incorporated herein by reference. Polymer systems for sealing containers which can be activated by electromagnetic energy frequencies of 0.1–30,000 MHZ, including radio frequency and microwave heating, are disclosed in U.S. Pat. 4,787,194 which is incorporated herein by reference. RF sealable, non-foil acrylate based polymers for packaging applications are disclosed in U.S. Pat. No. 4,660,354 (Example 1) and WO 95/03939 which are also incorporated herein by reference.

Heat sealing the liner to a flap or the front panel of the pour spout is done in a way to locally weaken the liner to facilitate separation of a portion of the liner upon initial opening of the pour spout or flap. In one embodiment, this can be accomplished by attaching a metal foil laminate to the front panel of the pour spout or to the fitment which defines the dispensing opening. The foil can be configured so as to concentrate heat at the edges of the dispensing opening which crates a weakened or thinned tear line without breaking the seal of the bag.

A preferred liner is biaxially oriented, laminated high density polyethylene film. Such films will tear easily in the longitudinal or machine direction and to impart better tearability in the transverse direction, fillers such as finely divided calcium carbonate, silica, diatomaceous earth and the like can be added to the film. A suitable film can have two high density polyethylene layers containing 15% by weight finely divided silica in the inner layer and 10% in the outer layer.

In another embodiment, a fitment defining a dispensing opening, preferably with a cut-out piece, is positional between the liner and the front panel of a pour spout. This defines a focused seal area around the periphery of the dispensing opening and consequently a weakened seal line which facilitates separation from the liner.

Other methods of scoring a liner include applying a metal containing substance, such as a metal foil or a metal ink, directly to the liner, and then exposing the liner to an induction field.

Figure 4:
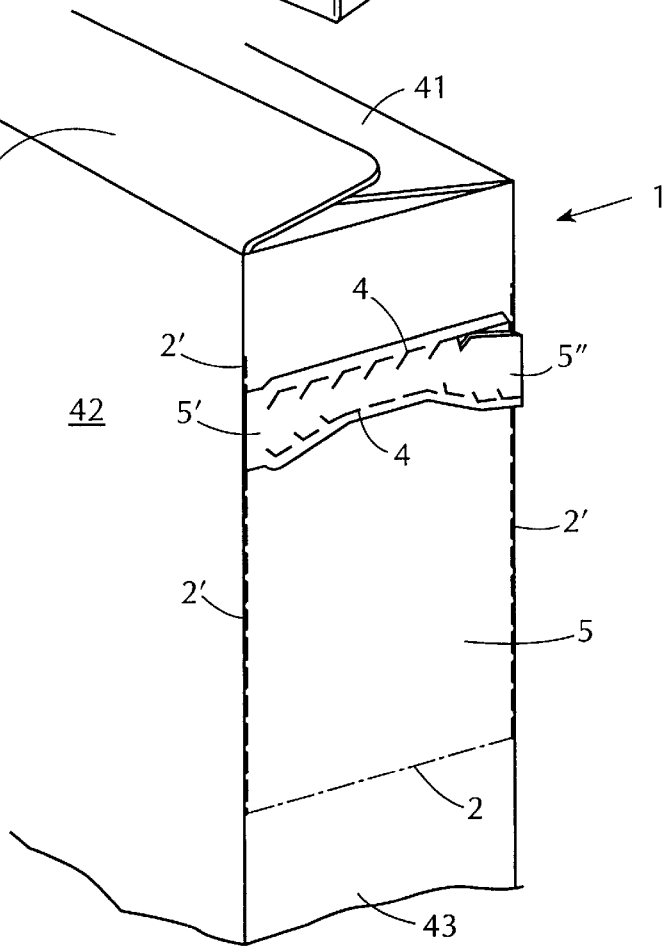
FIG. 4 is a perspective view of a carton with access to a dispensing assembly of the invention.
Figure 5:
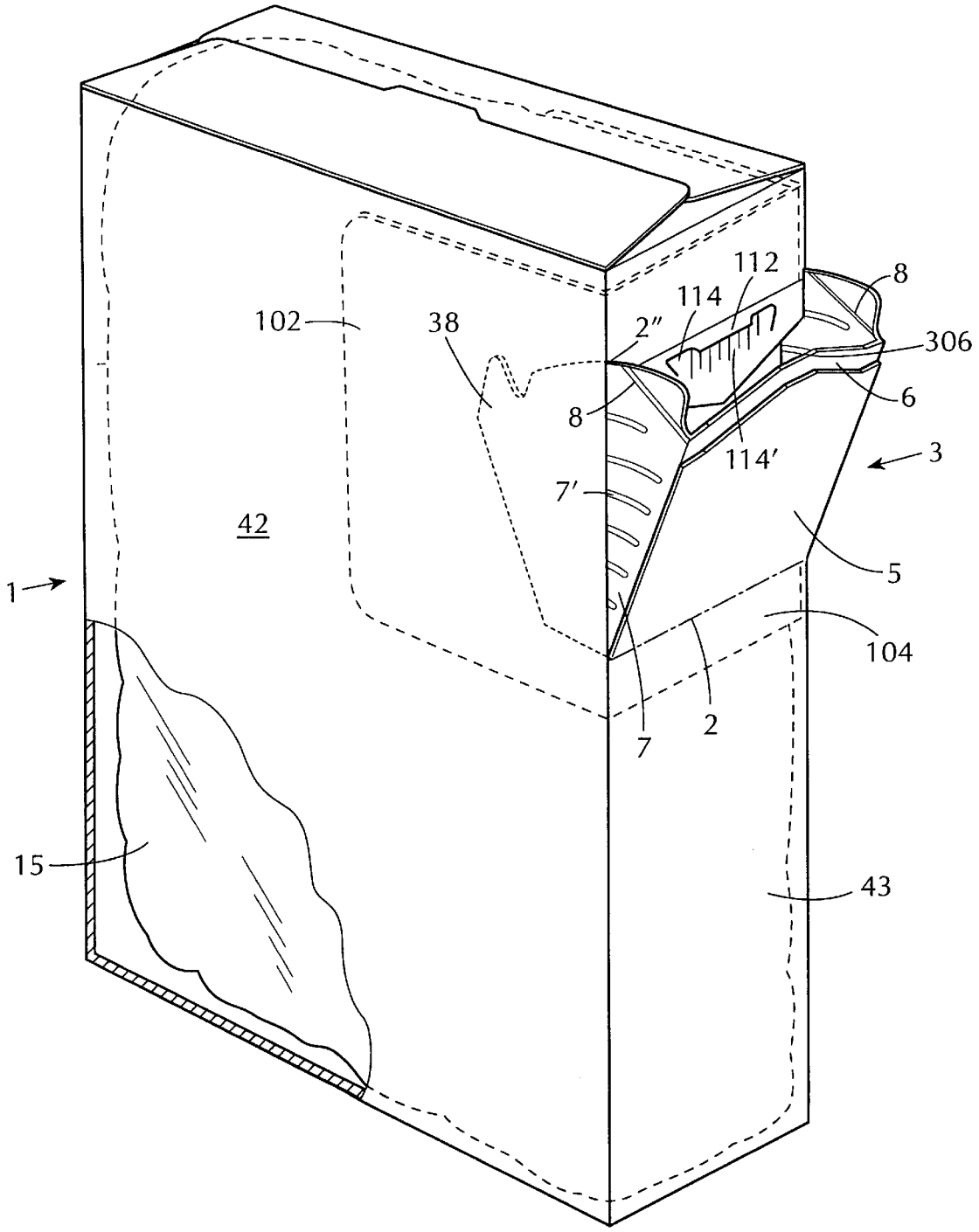
FIGS. 5 and 6 are perspective views of a dispensing assembly of the invention partly open and fully open.
Figure 6:
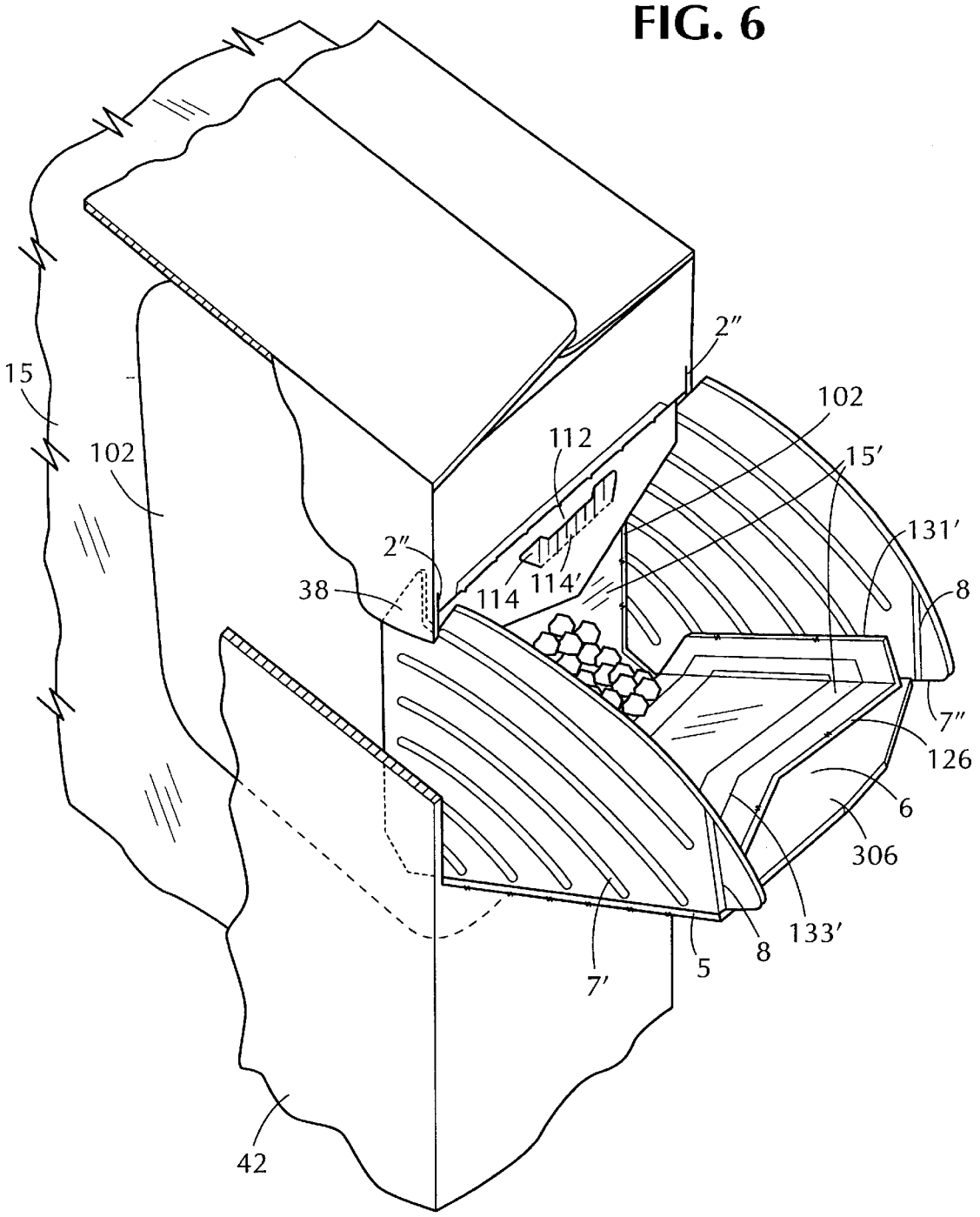

Referring now to FIGS. 4–6 of the drawing, the dispensing assembly of the invention, shown generally by reference numeral 3, is mounted to a dispensing opening in carton 1.

Carton 1 includes side walls 42, end walls 43 and top flaps 40 and 41. The carton bottom is defined by similar flaps which are folded over and adhered to each other (not shown).

Figure 3:
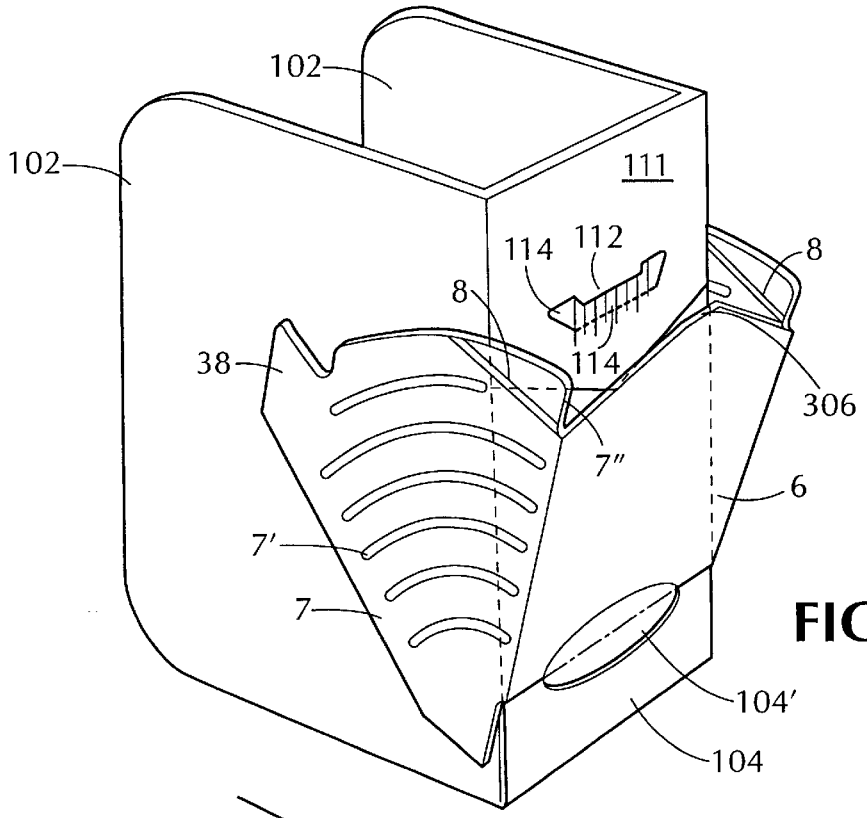
FIG. 3 is a perspective view of the pour spout assembly of FIG. 2 shown folded and partly open.

A sealed plastic liner bag 15 with particulate product such as RTE cereal is in carton 1. Access panel 5, which is perforated on three sides from end wall 43 so as to pivot around axis 2, carries the pour spout which includes front panel 6 and side panels 7 (FIG. 3). Access to pour spout 3 can be gained by removing strip 5 between perforated lines 4 via pull tab 5" thus exposing an upper portion of front panel 6 (FIGS. 4 and 5). Alternatively, panel 5 can abut a cut line in end wall 43 which can be covered by a peal off tape which can be removed for initial opening of the pour spout 3. Resealable peel-off tape can cover panel 5 and the surrounding areas to insure freshness.

Figure 1B:
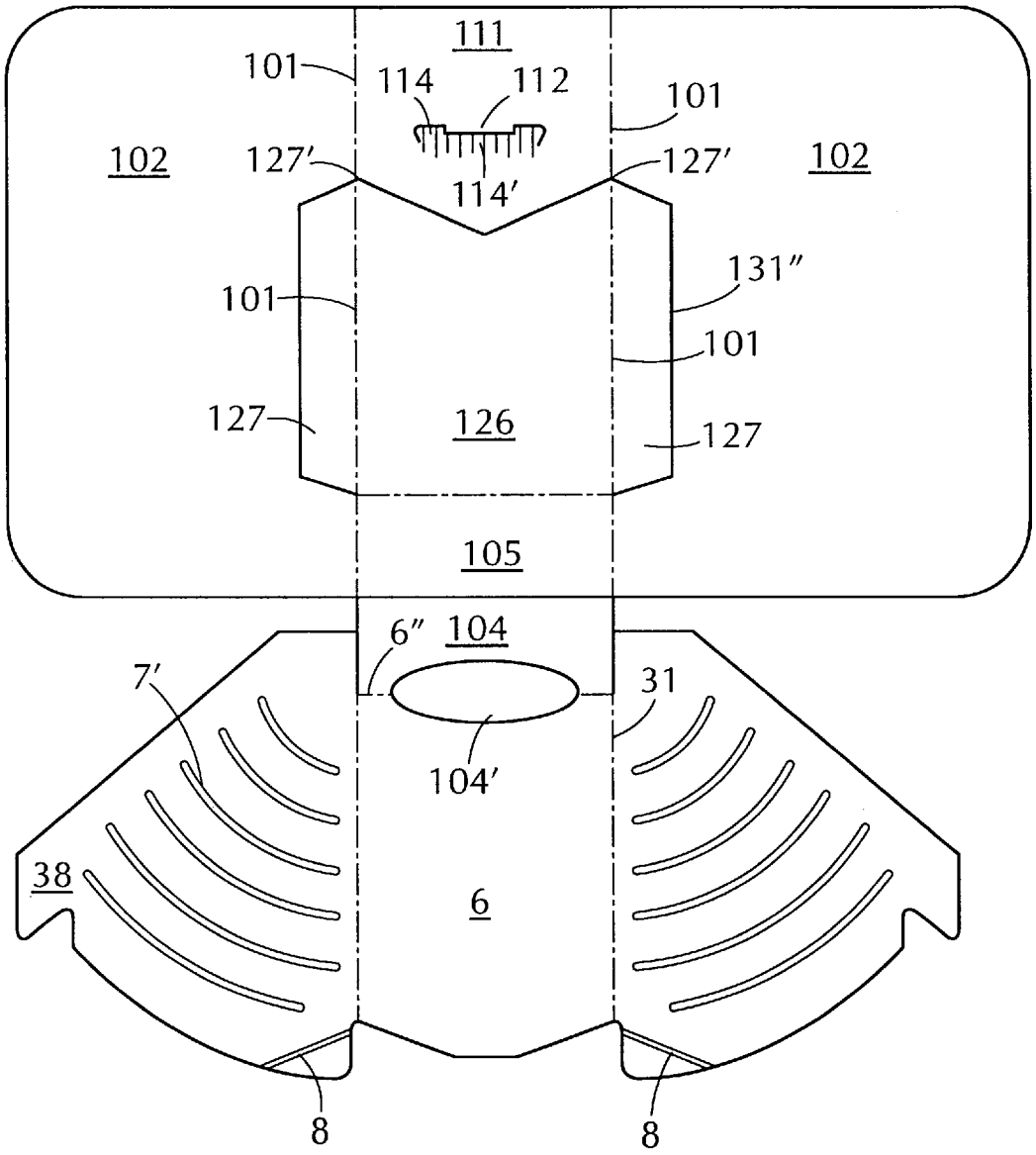
FIG. 1B is a plan view of the other side of the pour spout of FIG. 1A.
Figure 2:
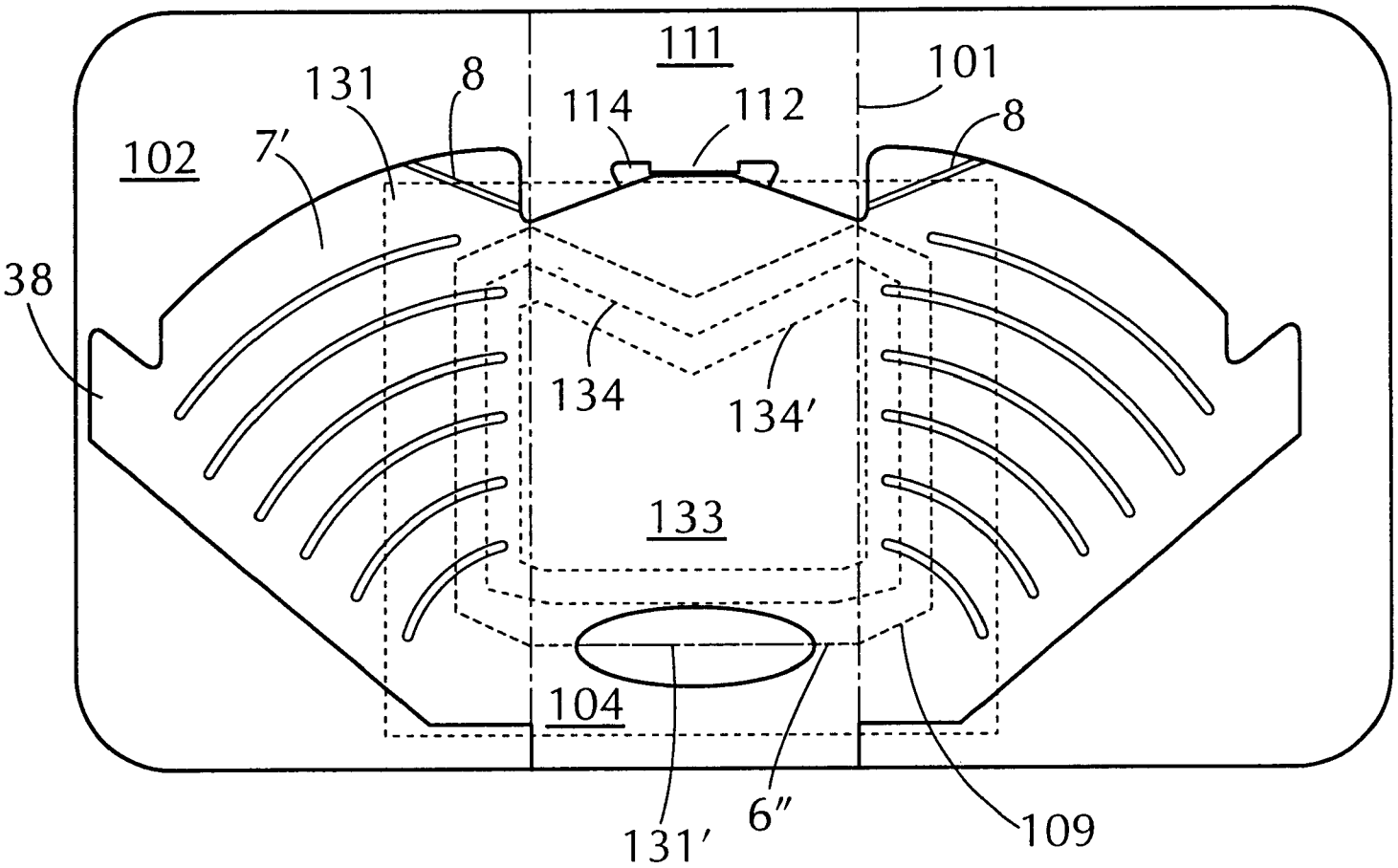
FIG. 2 is a plan view of the assembly of FIG. 1B turned over with the pour spout folded over a fitment which defines a dispensing opening shown in phantom.

In the embodiment shown in FIGS. 1-3, the pour spout assembly has side panels 7 joined to front panel 6 along fold lines 31. Side panels 7 have stepped portions 7" and ears 38 which interact with end wall 43 and cuts 2" to define the open and closed positions of the pour spout. Side panels 7 have curved embossed areas 7' to stiffen or reinforce the panels 7 for closing the pour spout and diagonal embossed lines 8 to allow the stepped portions 7" to flex if necessary to fit between side wall 42 and end wall 43 at 2".

Front panel 6 in integral with fitment 100 via panel 104. Fitment 100 has upper and lower margin portions 111 and 105, respectively, side members 102 and a cut-out piece having a central section 126 and vertical side pieces 127 which extend into side members 102 (FIG. 1B) to define dispensing opening 109 along line 131' as shown in dotted lines under bonding member 9 (FIG. 2).

Front panel 6 has a tab 306 which releasably interlocks with tab 112 and panel 114 having slits 114' of upper margin portion 111 when spout panel 6 is folded over fitment 100 (FIG. 2).

In one embodiment, upper margin portion 11 can have laterally extending flexible tabs (now shown) that interact with stepped portions 7" and cut-outs adjacent ears 38 (not shown) to hold the spout in the open and closed positions. Ears 38 prevent pull-out of the spout. Stepped portions 7" slide through cuts 2" in end wall 43.

When the pour spout is folded over fitment 100 (FIG. 2), connecting panel 104 ties on top of lower margin portion 105 and front panel 6 covers central section 126 of cut-out 126/127 and pivots at line 6" which is aligned with the bottom of opening 109. Oval cut-out 104' along line 6" facilitates flexing and bending of the pour spout. Side members 127 are folded at right angles to panel 6 and cut-out 126/127 fits into dispensing opening 109 defined by fitment 100 when the pour spout is closed.

The pour spout and fitment can be spot or hard glued to the interior of carton end wall 43 via upper portion 111 and lower portion 105. One side member 102 can be wider to provide an area 102' (FIGS. 1A and B) to spot or hard glue to the interior of carton side 42 before the carton is erected. This insures that side members 102 will stay flat against the interior side walls of the carton when erected so as not to interfere with the insertion of a filled and sealed bag.

The top of opening 109 is V-shaped and the upper corners provide areas of reduced resistance to initiate separation of the liner bonded to cut-out 126/127 from liner 15 itself.

Figure 8A:
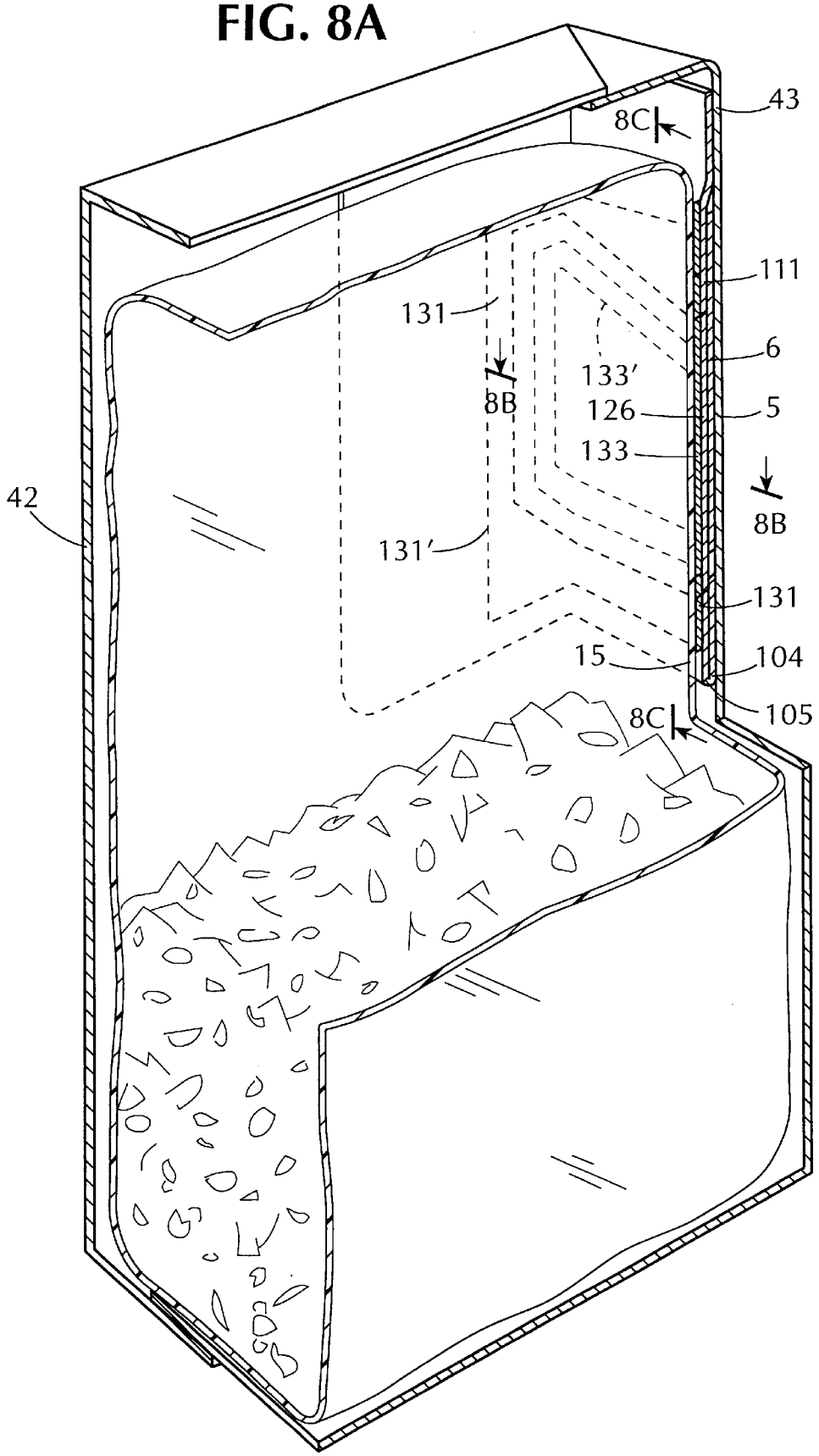
FIG. 8A is a perspective view, broken away, of the interior of a dispensing assembly of the invention.
Figure 8B:
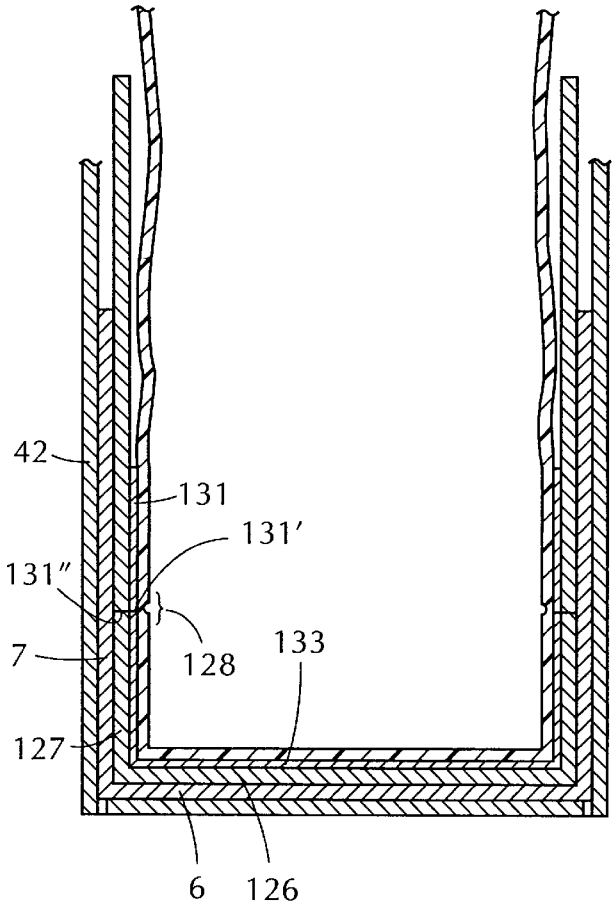
FIGS. 8B and 8C are cross-sectioned views taken along lines 8B—8B and 8C—8C of FIG. 8A.
Figure 8C:
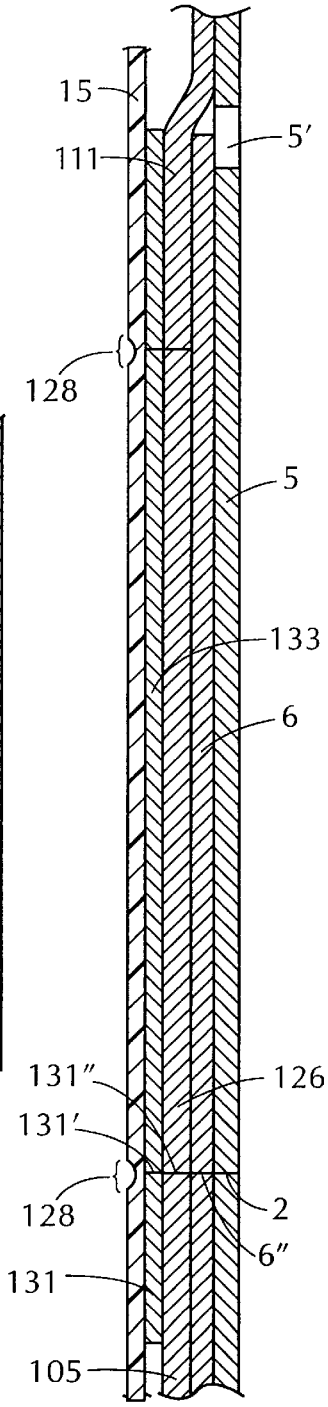
Figure 8D:
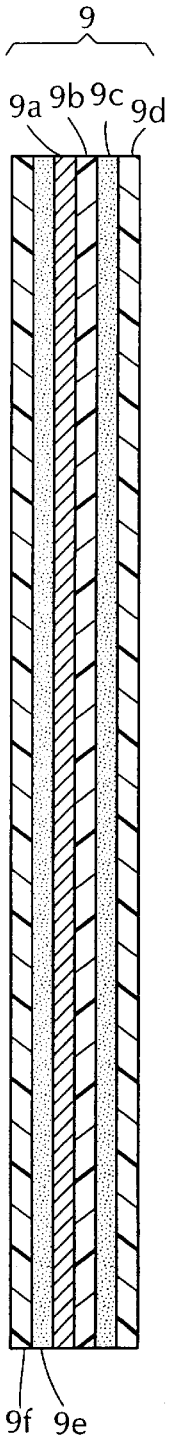
FIG. 8D is a cross-sectional view of laminated foil used to promote bonding.
Figure 10:
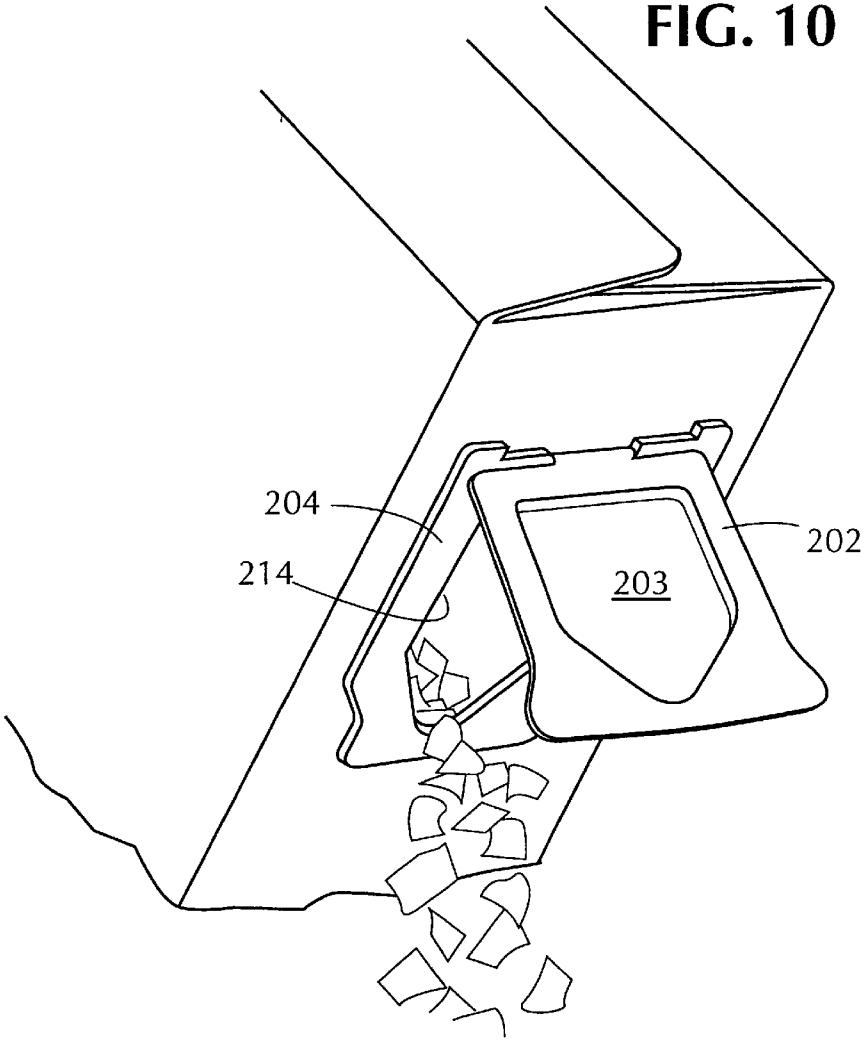
FIGS. 9 and 10 are perspective views of an alternate dispensing assembly show closed and open.
Figure 9:
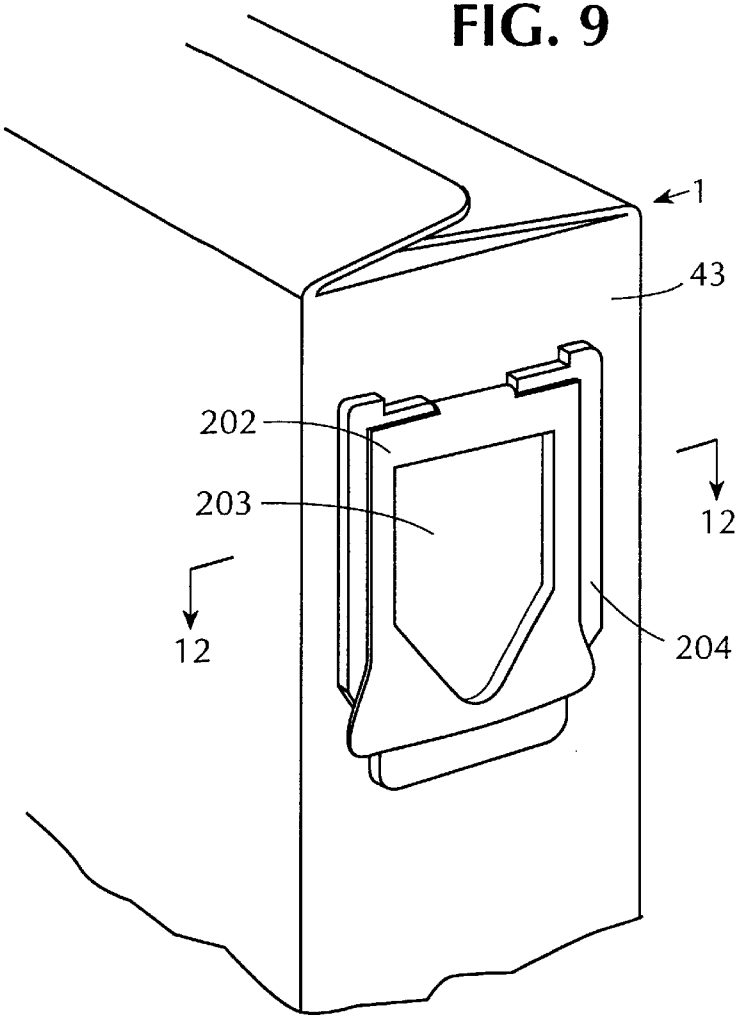
Figure 12:
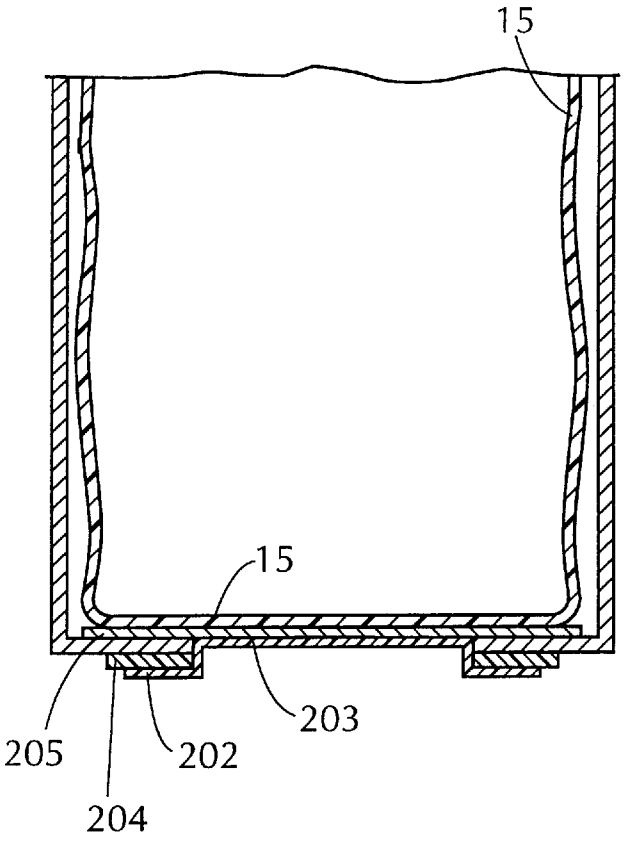
FIG. 12 is a cross-sectional view taken along line 12—12 of FIG. 9.
Figure 11:
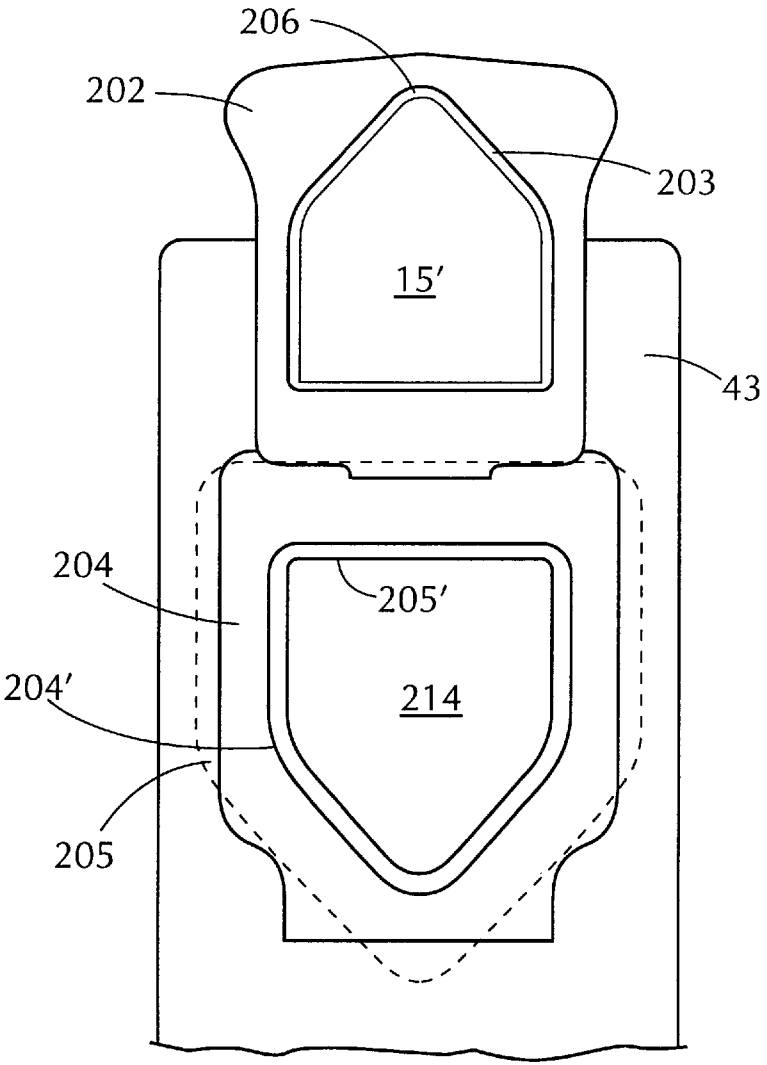
FIG. 11 is a front view of the assembly of FIGS. 9 and 10 shown fully open.

A preferred bonding member 9 (FIGS. 1A and 2) is a metal foil laminate having an outer member 131 and an inner member 133. As shown in FIG. 8D, a preferred member 9 includes a layer of metal foil 9*a* such as aluminum foil or vacuum metalized aluminum adhered to polyester layer 9*b*. Adhesive layers 9*c* and 9*e* flank both sides of the polyester/foil laminate. Linear low density polyethylene adhesive layers define the outermost layers 9*d* and 9*f*. The overall thickness of member 9 is about 5 mils.

Bonding member 9 can be adhered to fitment 100 in a number of ways. It can be fully glued in place using a pressure sensitive, heat activated or other adhesive. It can also be spot glued for later full gluing by actuating adhesive layer 9*d* or 9*f* at the same time the other layer is bonded to liner 15.

Margin portions 111 and 105 and side members 102 surround opening 109. Inner member 133 corresponds to opening 109 and is connected to outer member 131 via perforation line 131' about the periphery of opening 109.

Inner member 133 has score lines 134 and 134' in the shape of inner member 133 to concentrate heat for bonding around the periphery of line 131'. This creates a weakened seal line in the area of line 131' to facilitate initial opening of the pour spout, especially at the upper comers of opening 109 where cut-out members 126 and 127 meet along fold line 101.

Figure 7:
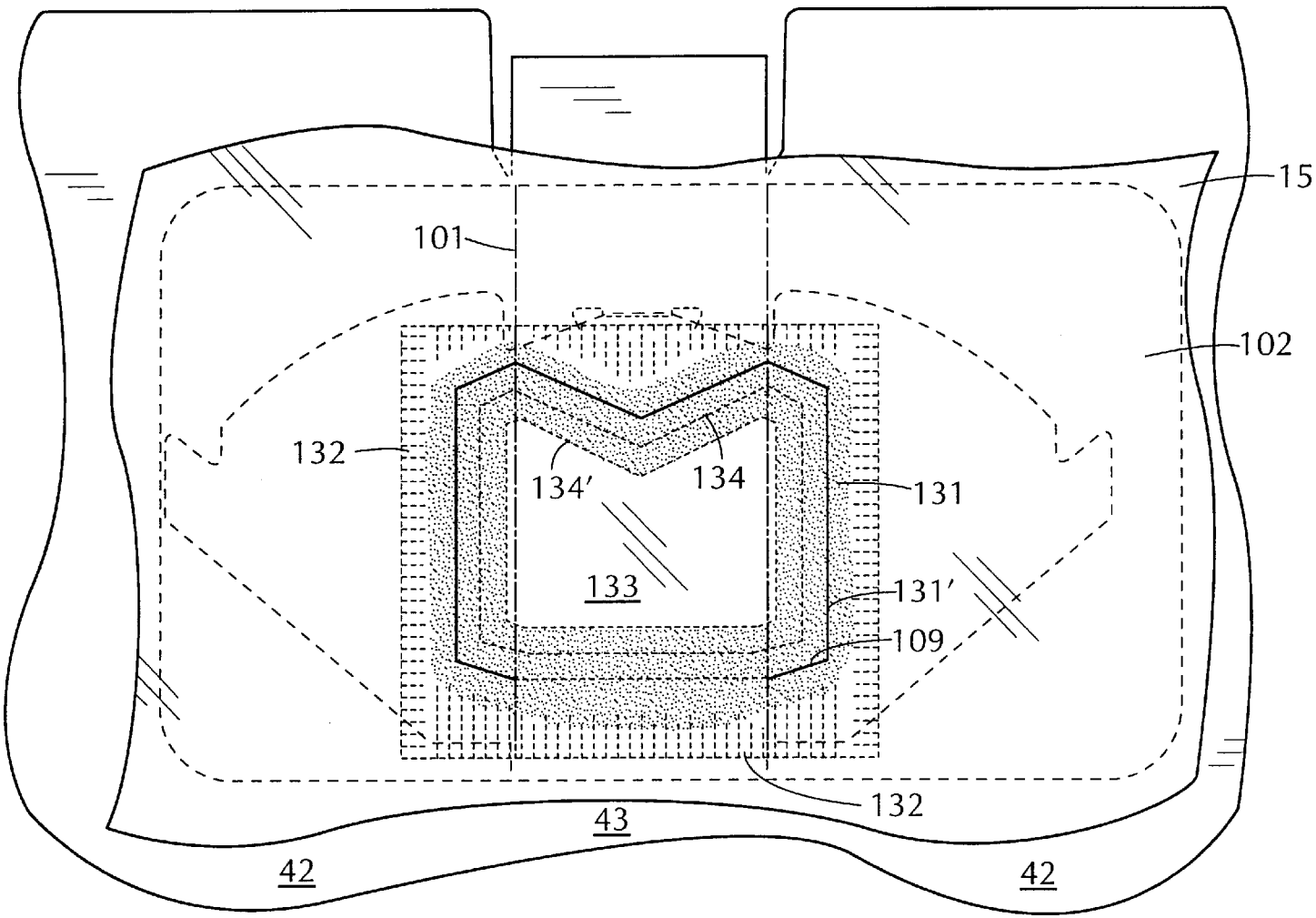
FIG. 7 is a plan view showing the assembly of FIG. 1A with the pour spout folded under a fitment (FIG. 2 turned over) and positioned on the interior of a flat carton blank.
Figure 13A:
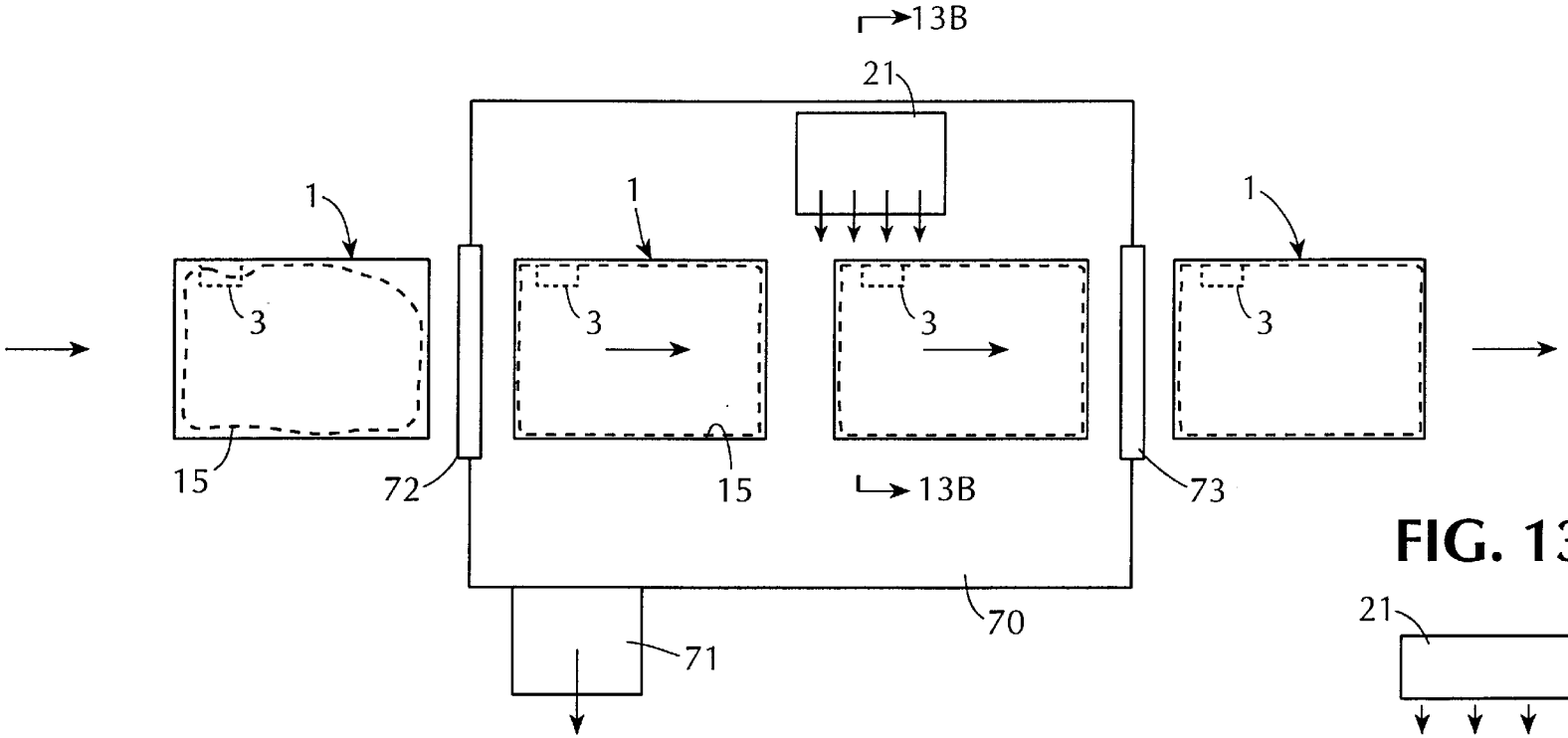
FIG. 13A is a diagrammatic view of apparatus for sealing a liner to the pour spout assembly.
Figure 13B:
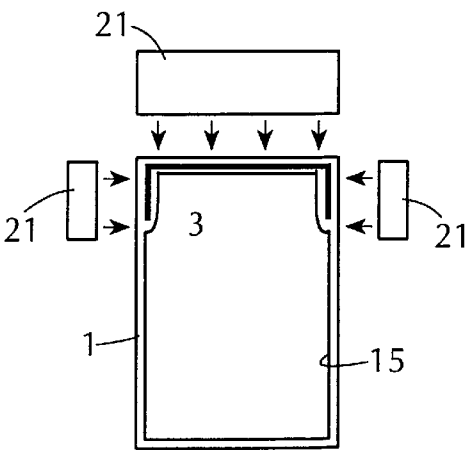
FIG. 13B is a cross-sectional view along line 13B—13B of FIG. 13A.

Outer member 131 has a series of graduated fingers or cuts 132 which help to distribute bonding heat over the area of member 131 and away from the outer edges to prevent the formation of weak spots when liner 15 is bonded to the area surrounding opening 109 to maintain alignment of the liner with the pour spout. Fingers 132 also cooperate with score lines 134 and 134' to concentrate bonding heat along line 131 'to form a thinner or weakened tear line in liner 15. In the embodiment shown in FIG. 7, liner 15 is bonded to outer member 131 in an area between fingers 132 and line 131' and to inner member 133 in the areas defined by line 131' and score lines 134 and 134'. In order to bring liner bag 15 into contact with pour spout 3, referring to FIGS. 13A and B, a filled carton is passed through enclosure 70 via air locks 72 and 73 which maintain an area of reduced pressure in enclosure 70 via vacuum pump 71. Because sealed liner bag 15 contains atmospheric air, the application of a vacuum has the effect of inflating liner bag 15 forcing it tightly against the interior of the carton and fitment 100. See, FIGS. 7 and 8-A–C. While in this state, the carton 1 enters a heat sealing zone provided with an induction heating device 21. A suitable induction heater is a Model XP20 made by Amer-itherm Inc.

To insure that liner 15 reaches into the comers formed when cut-out side members 127 are folded at a right angle to center section 126 along line 101 (FIGS. 1A and B), means can be employed before a carton enters vacuum enclosure 70 to put pressure on the product in liner 15 to cause it to settle neatly into the comers. For example, plunger means can be used to force the sealed liner into the recesses of the carton before closing the top or bottom of the carton. Such liners are normally filled with product leaving such head space which allows the use of a plunger without damaging the product.

After a carton is sealed it can be placed on edge, pour spout down, and passed thru a shaking station such as a conveyor belt running over a series of eccentric rollers or wheels. This is effective to cause the product to settle and push the liner into the recesses of the pour spout assembly.

A sealed carton can also be squeezed at the sides before or in enclosure 70 using the head space to protect the product and force the liner into the corners of the pour spout assembly.

Heat delivered via induction heater 21 heats inner and outer members 131 and 133 which in turn activates adhesive layers corresponding to layers 9*d* and 9*f* of FIG. 8D. Adhesive layer 9*d* adheres member 9 to cut-out 126/127, side members 102 and margin portions 105 and 111. See FIGS. 1A and B. Because heat generated by foil layer 9*a* becomes concentrated as shown and described in FIG. 7, a thinning of liner 15 occurs at 128 (FIGS. 8B and C) around the edges of cut-out 126/127 to facilitate initial opening of the pour spout. While liner 15 is thinned along line 131', the seal of the bag is not broken until the pout spout is opened by the consumer.

To open the pour spout of FIGS. 1–7, tab 5" is pulled to remove section 5'. This exposes tab 306 of front panel 6 which extends above access panel 5. Insertion of one or more fingers behind tab 306 will cause the liner to begin to tear at the upper comers of center section 126 where they join side sections 127 along fold line 101. Continued pulling separates panel 5 along lines 2' and the liner along line 131' until it reaches the bottom comers of center section 126 when the spout is fully open. Liner 15 remains connected to outer member 131 where it is attached to side members 102 and margin portions 105 and 111.

In the embodiment shown, spout side panels 7 pivot in and out between a narrow space defined by side members 102 and carton side walls 42 without coming into contact with liner 15.

Upon closing of the spout, cut-out 126/127 fits neatly back into dispensing opening 109 defined by side members 102 and margin portions 105 and 111 of fitment 100 to minimize invasion of exterior air. When closed, recess 7" of the side panels slip behind cuts 2" to maintain closure of the spout. For added holding power, tab 306 interlocks with members 112 and 114 providing a "snap" closure to insure freshness.

To demonstrate that the embodiment shown can maintain freshness, moisture gain tests were conducted with Froot Loops® in a standard, top entry bag-in-box package and in a pour spout package of FIG. 5. All packages used the same liner used for standard package Froot Loops®. Accelerated tests were conducted at 100° F. and 70% relative humidity for 2 weeks. Three samples were used for each test.

The standard package liners were well reclosed (folded over as many times as possible and creased); fairly reclosed (folded over as many times as possible but not creased); and poorly reclosed (pushed back in the package and left partially open).

All packages were samples initially for moisture content and again after 1, 2, 4, 7, 10 and 14 days to simulate how a consumer would consume the cereal. The percent of moisture gain was measured against the initial moisture content and is reported in the following table:

TABLE

| Package | Moisture Gain |
|---|---|
| Standard package poorly reclosed | 4.0% |
| Standard package fairly reclosed | 3.3% |
| Standard package well reclosed | 2.9% |
| FIG. 5 pour spout package reclosed with recesses 7" and Tabs 112 and 306 | 2.7% |
| FIG. 5 pour spout package reclosed with recesses 7" only | 2.9% |

Thus, without using closure tabs 112 and 306 (which is the normal way of reclosing the pour spout of the invention), moisture gain equals the most careful way of reclosing a standard package. The FIG. 5 pour spout package using the closure tabs is better then all three ways of closing a standard package.

FIGS. 9–12 show an alternate embodiment wherein pour door 202 with a recessed center section 203 snaps into frame 204 which is mounted to a dispensing opening 214 in end wall 43 of carton 1.

Metal foil laminate 205 (similar to member 9) is perforated along line 205' and is adhered to the interior of end wall 43 over opening 214.

Liner 15 is adhered via laminate 205 using the process of FIG. 19 to the interior end wall 43 surrounding opening 214 and to recessed portion 203 of door 202. When pour door 202 is lifted up the first time, portion 15' separates from liner 15 along line 205' providing access to the contents thereof. Initial separation of portion 15' takes place where opening 214 is pointed (at 206) which offers less resistance than trying to tear an entire side at one time.

Liner 15 and its contents remain aligned with opening 214 because the liner 15 is adhered via member 205 to end wall 43 around opening 214.

What is claimed is:

1. Dispensing assembly comprising;

(a) a carton having a dispensing flap in a side wall thereof, said flap having top and side edges, and a liner therein filled with product and sealed;

(b) said filled liner being bonded to said side wall adjacent said dispensing up and to said flap along a weaken tear line corresponding to the top and side edges of said dispensing flap without breaking the seal of said liner whereby upon initial opening of said flap that portion of the liner bonded thereto separates along said weakened tear line providing access to the contents of said carton.

2. Dispensing assembly of claim 1 wherein said flap includes means to promote bonding with said liner.

3. Dispensing assembly of claim 2 wherein said means to promote bonding comprises a heat generator and a heat activatable adhesive.

4. Dispensing assembly of claim 3 wherein the heat generator is selected from the group consisting of a metal foil, a metallic salt and metal particles.

5. Dispensing assembly comprising:

(a) a carton having a dispensing opening in a side wall thereof and a liner therein;

(b) a pour spout mounted in said dispensing opening pivotable between open and closed positions and including a front panel;

(c) said liner being bonded to said front panel whereby upon initial opening of the pour spout that portion of the liner bonded to said front panel separates from said liner providing access to the inter or thereof.

6. Dispensing assembly of claim 5 wherein said font panel includes means to promote bonding with said liner.

7. Dispensing assembly of claim 6 wherein said means to promote bonding comprises a heat generator and a heat activatable adhesive.

8. Dispensing assembly of claim 7 wherein the heat generator is selected from the our consisting a metal foil, a metallic salt and metal particles.

9. Dispensing assembly of claim 5 including means to lock said pour spout in its open and closed positions.

10. Dispensing assembly comprising:

(a) a carton having side and end walls and a sealed liner therein containing particulate product;

(b) an access panel severably connected to one wall of said carton and pivotable at an integral base thereof;

(c) a fitment having a dispensing opening and an upper margin portion attached to the interior of said one wall such that said access panel overlies said dispensing opening overlies said access panel; and (d) a pour spout having side panels and a front panel, said front panel being bonded on one side to the interior of said access panel to pivot therewith between open and closed positions, and on the other side to said liner in an area corresponding to said dispensing opening such that upon initial opening of the pour spout, that portion of the liner bonded to said front panel separates from said liner providing access to the contents thereof.

11. Dispensing assembly of claim 10 wherein said fitment includes side members adjacent said dispensing opening forming a narrow space with the side walls of said carton for receiving the side panels of said pour spout.

12. Dispensing assembly of claim 10 wherein the front panel of said spout has a tab adapted to interlock with releasable locking tab in the upper margin portion of said fitment.

13. Dispensing assembly of claim 10 wherein said wall having said access panel has a removable section overlying a segment of the upper margin portion of said fitment adjacent said dispensing opening.

14. Dispensing assembly of claim 10 wherein said side panels of said spout hive means to hold said spout in the open and closed positions.

15. Dispensing assembly of claim 11 wherein said fitment includes a cut-out member defining the dispensing opening which is bonded to the interior of the front panel of said pour spout.

16. Dispensing assembly of claim 15 wherein said cut-out member has center and vertical side sections, said center section being bonded to the interior of the front panel of said pour spout and said side sections extending into the side members of said fitment at right angles to said center section.

17. Dispensing assembly of claim 10 wherein the front panel of said spout includes means to promote bonding to said liner.

18. Dispensing assembly of claim 15 wherein said cut-out member includes means to promote bonding to said liner.

19. Dispensing assembly of claim 16 wherein said center and vertical side sections include means to promote bonding to said liner.

20. Dispensing assembly of claim 18 wherein said means to promote bonding comprises a heat generator and a heat activatable adhesive.

21. Dispensing assembly of claim 20 wherein said heat generator is a selected from the group consisting of metal foil, a metallic salt and metal particles.

22. Dispensing assembly of claim 10 wherein said side panels are stiffened to facilitate closing of said pour spout.

23. Pour spout comprising:

(a) a fitment having a dispensing opening and upper and lower margin portions adjacent said dispensing opening;

(b) a pour spout having side panels and a front panel pivoting between open and closed positions about the base of said front panel, said front panel being integral with said lower margin portion such that when the pour spout is folded over said fitment, said front panel overlies said dispensing opening.

24. Pour spout of claim 23 wherein said fitment includes side members adjacent said dispensing opening.

25. Pour spout of claim 24 wherein said fitment includes a cut-out member defining the dispensing opening which is bonded to the interior of the front panel of said pour spout.

26. Pour spout of claim 25 wherein said cut-out member has center and vertical side sections, said center section being bonded to the interior of the front panel of said pour spout and said side sections extending into the side members of said fitment at right angles to said center section.

27. Pour spout of claim 23 wherein the front panel of said spout has a tab adapted to interlock with a releasable locking tab in said upper margin portion.

28. Pour spout of claim 25 wherein means to promote bonding with a carton liner are adhered to the interior of said fitment.

29. Pour spout of claim 28 wherein the side panels of said pour spout have means to hold said pour spout in the open and closed positions.

30. Pour spout of claim 28 wherein said means to promote bonding comprises a heat generator and a heat activatable adhesive.

31. Pour spout of claim 30 wherein the heat generator concentrates heat at the edges of said dispensing opening to form a weakened tear line in the liner.

32. Process for making a dispensing assembly comprising:

(a) providing a carton having a dispensing flap in a side wall thereof, said flap having top and side edges and a liner therein filled with product and sealed;

(b) bonding said liner to said side wall adjacent said dispensing flap and to said flap along a weakened tear line corresponding to the top and side edges of said dispensing flap without breaking the seal of the liner whereby upon initial opening of said flap that portion of the liner bonded thereto separates from said liner along said weakened tear providing access to the contents of said carton.

33. Process for making a dispensing assembly comprising:

(a) providing a carton having a dispensing opening in a side wall thereof, a pour spout having a front panel mounted in said dispensing opening and a separate liner in said carton;

(b) bonding said liner to said front panel whereby upon initial opening of the pour spout means, that portion of the liner bonded to said front panel separates from said liner providing access to the interior thereof, wherein said front panel is provided with means to promote bonding to said liner and bonding energy is delivered to the interface between said front panel and said liner.

34. Process of claim 33 wherein said liner is filled and sealed and said portion of said liner is brought into contact with said front panel for bonding thereto.

35. Process of claim 34 wherein said carton is exposed to an area of reduced pressure to bring a portion of said liner into contact with said front panel for bonding thereto.

36. Process of claim 35 wherein said carton is subject to pressure or shaking to bring said liner into contact with said front panel.

37. Process of claim 33 wherein an induction heating source delivers said bonding energy.

38. Process for making a dispensing assembly comprising:

(a) providing a carton having side and end walls, a separate liner therein adapted to contain particulate product, a fitment having a cut-out defining a dispensing opening and an upper margin portion and a pour spout having side panels and a front panel;

(b) providing an access panel severably connected to one wall of said carton means and pivotable at an integral base thereof;

(c) attaching said fitment to the interior of said one wall such that said access panel overlies said cut-out defining a dispensing opening;

(d) bonding the front panel of said pour spout to one side to the interior of said access panel to pivot therewith between open and closed positions, and on the other side to said cut-out; and (e) bonding said liner to said cut-out such that upon initial opening of the pour spout, that portion of the liner bonded to said cut-out separates from said liner providing access to the contents of the carton.

39. Process of claim 38 wherein said liner is filled and sealed and said portion of said liner is brought into contact with said cut-out for bonding thereto.

40. Process of claim 39 wherein said carton is exposed to an area of reduced pressure to bring a portion of said liner into contact with said cut-out for bonding thereto.

41. Process of claim 38 wherein said fitment is provided with means to promote bonding to said liner and bonding energy is delivered to the interface between said fitment and said liner.

42. Process for making a pour spout assembly comprising:

(a) forming a fitment having a cut-out defining a dispensing opening and upper and lower margin portions adjacent said cut-out;

(b) forming a pour spout having side panels and a front panel pivoting between open and closed positions about the base of said front panel, said front panel being integral with the lower margin portion of said fitment; and (c) folding said pour spout over said fitment such that said front panel overlies said cut-out.

43. Process of claim 42 wherein means to promote bonding with a liner are applied to said cut-out and to said fitment adjacent said cut-out.

44. Apparatus for providing a carton with a dispensing assembly which comprises:

(a) means for providing a carton having a dispensing flap in a side all thereof, said flap having top and side edges and liner therein filled with product and sealed;

(b) means to bring said liner into contact with said flap; and (c) means to bond said liner to said side wall adjacent said dispensing flap and to said flap along a weakened tear line corresponding to the top and side edges of said dispensing flap without breaking the seal of said liner whereby upon initial opening of said flap that portion of the liner bonded thereto separates alone said weakened tear line providing access to the contents of said carton.

45. Apparatus of claim 44 wherein said means to bring said liner into contact with said means to promote bonding comprises pressure or shaking means.

46. Apparatus for providing a carton with a dispensing assembly which comprises (a) means for providing a carton having a dispensing opening in a side wall thereof, a pour spout having a front panel mounted in said dispensing opening, a separate liner therein and means to promote bonding between said liner and said front panel;

(b) means to bring said liner into contact with said front panel; and (c) means to deliver bonding energy to the interface between said liner and said front panel to bond same whereby upon initial opening of the pour spout that portion of the liner bonded to said front panel separates from said liner providing access to the interior thereof.

47. Apparatus of claim 46 wherein said means to bring said liner into contact with said front panel comprises reduced pressure means.

48. Apparatus of claim 46 wherein said means to deliver bonding energy comprises an induction heating source.

49. Apparatus for providing a carton with a dispensing opening comprising:

(a) means for providing a carton blank having side and end walls and an access panel in one wall thereof;

(b) means for providing a pour spout having side panels and a front panel and a fitment having a cut-cut defining a dispensing opening, upper and lower margin portions and side members adjacent said opening, said fitment being folded over said pour spout such that said cut-out overlies said front panel;

(c) means for applying means to promote bonding to a carton liner to said cut-out and said fitment adjacent said cut-out;

(d) means for adhering one side of said front panel to said access panel and the other side to said cut-out;

(e) means to erect a carton from said carton blank and to insert therein a sealed liner containing particulate product;

(f) means to bring said liner into contact with said means to promote bonding; and (g) means to deliver bonding energy to the interface between said liner and said means to promote bonding whereby upon initial opening of the pour spout, that portion of the liner bonded to said cut-out separates from said liner providing access to the contents thereof.

50. Dispensing assembly comprising (a) a carton having a dispensing flap in a side wall thereof defining a dispensing opening and a liner therein;

(b) a pour spout having a front panel bonded to said dispensing flap and pivotable in said dispensing opening between open and closed positions;

(c) said liner being bonded to said front panel whereby upon initial opening of the pour spout that portion of the liner bonded to said front panel separates from said liner providing access to the interior thereof, wherein said means to promote bonding comprises a heat generator and a heat activatable adhesive.

51. Dispensing assembly of claim 50 wherein said front panel includes means to promote bonding with said liner.

52. Dispensing assembly of claim 50 wherein the heat generator is selected from the group consisting of a metal foil, a metallic salt and metal particles.

53. Dispensing assembly of claim 50 including means to lock said pour spout in its open and closed positions.

54. Process for making a dispensing assembly comprising;

(a) providing a carton having a dispensing flap in a side wall thereof defining a dispensing opening, a pour spout having a front panel pivotable in said dispensing opening between open and closed positions, and a separate liner therein;

(b) bonding said liner to said front panel whereby upon initial opening of he pour spout, that portion of the liner bonded to said front panel separates from said liner providing access to the interior thereof, wherein said front panel is provided with means to promote bonding to said liner and bonding energy is delivered to the interface between said front panel and said liner.

55. Apparatus for providing a carton with a dispensing assembly which comprises:

(a) means for providing a carton having a dispensing flap in a side wall thereof defining a dispensing opening, a pour spout having a front panel pivotable in said dispensing opening between open and closed positions, and a separate liner therein;

(b) means for bonding said liner to said front panel whereby upon initial opening of he pour spout, that portion of the liner bonded to said front panel separates from said liner providing access to the interior thereof, wherein said front panel is provided with means to promote bonding to said liner and bonding energy is delivered to the interface between said front panel and said liner.

56. Dispensing assembly comprising:

(a) a carton having a dispensing opening in a side wall thereof and a separate liner therein;

(b) a pour spout mounted to said dispensing opening, said pour spout being pivotable between opened and closed positions and including a front panel;

(c) said front panel including a bonding member adapted to bond said liner thereto and to concentrate bonding energy to create a weakened tear line in said liner corresponding to said dispensing opening.

57. Dispensing assembly of claim 56 wherein said bonding member is a metal foil.

58. Process for preparing a dispensing assembly comprising:

(a) providing a carton having a dispensing opening in a side wall thereof, a separate filled and sealed liner therein and a pour spout mounted to said dispensing opening, said pour spout being pivotable between opened and closed positions and including a front panel having a bonding member, and (b) providing bonding energy to said bonding member to bond said liner to said front panel and create and to form a weakened tear line in the liner corresponding to said dispensing opening.

59. Dispensing assembly comprising:

carton having a dispensing flap and a liner therein filled with product and sealed therein;

said filled liner being bonded to said flap along a weakened tear line without breaking its seal whereby upon initial opening of the flap that portion of the liner bonded thereto separates from said liner along said weakened tear line thereby providing access to the contents of said carton.

* * * * *